United States Patent [19]

Fessler

[11] Patent Number: 4,477,354

[45] Date of Patent: Oct. 16, 1984

[54] DESTRUCTION OF POLYCHLORINATED BIPHENYLS DURING SOLVENT DISTILLATION

[75] Inventor: William A. Fessler, Pittsfield, Me.

[73] Assignee: Electric Power Research Institute, Palo Alto, Calif.

[21] Appl. No.: 415,271

[22] Filed: Sep. 7, 1982

[51] Int. Cl.[3] ..... C07C 7/10

[52] U.S. Cl. ..... 210/634; 203/36; 203/37; 208/282; 210/765; 210/909; 585/469

[58] Field of Search ..... 208/179, 180, 184, 187, 208/262; 210/634, 765, 766, 804, 805, 806, 909; 585/469, 864; 203/36, 37

[56] References Cited

U.S. PATENT DOCUMENTS

| | | | |
|---|---|---|---|
| 3,929,586 | 12/1975 | Slikkers, Jr. | 203/37 |
| 4,334,102 | 6/1982 | Decker et al. | 210/634 |
| 4,340,471 | 7/1982 | Jordan | 210/909 |
| 4,353,793 | 10/1982 | Brunelle | 208/262 |
| 4,379,746 | 4/1983 | Norman et al. | 210/909 |
| 4,379,752 | 4/1983 | Norman | 210/909 |
| 4,416,767 | 11/1983 | Jordan | 210/909 |

FOREIGN PATENT DOCUMENTS

| | | | |
|---|---|---|---|
| 49-82570 | 8/1974 | Japan | 210/909 |

OTHER PUBLICATIONS

Parker and Cox, Plant Engineering, Aug. 21, 1980, p. 133.

*Primary Examiner*—Peter A. Hruskoci
*Assistant Examiner*—W. Gary Jones
*Attorney, Agent, or Firm*—Flehr, Hohbach, Test, Albritton & Herbert

[57] ABSTRACT

A method is provided for removing polychlorinated biphenyl compounds (PCB) from oil contaminated therewith comprising the steps of extracting said oil with organic solvent, separating the extract, and distilling the solvent from said extract in the presence of a base.

8 Claims, 1 Drawing Figure

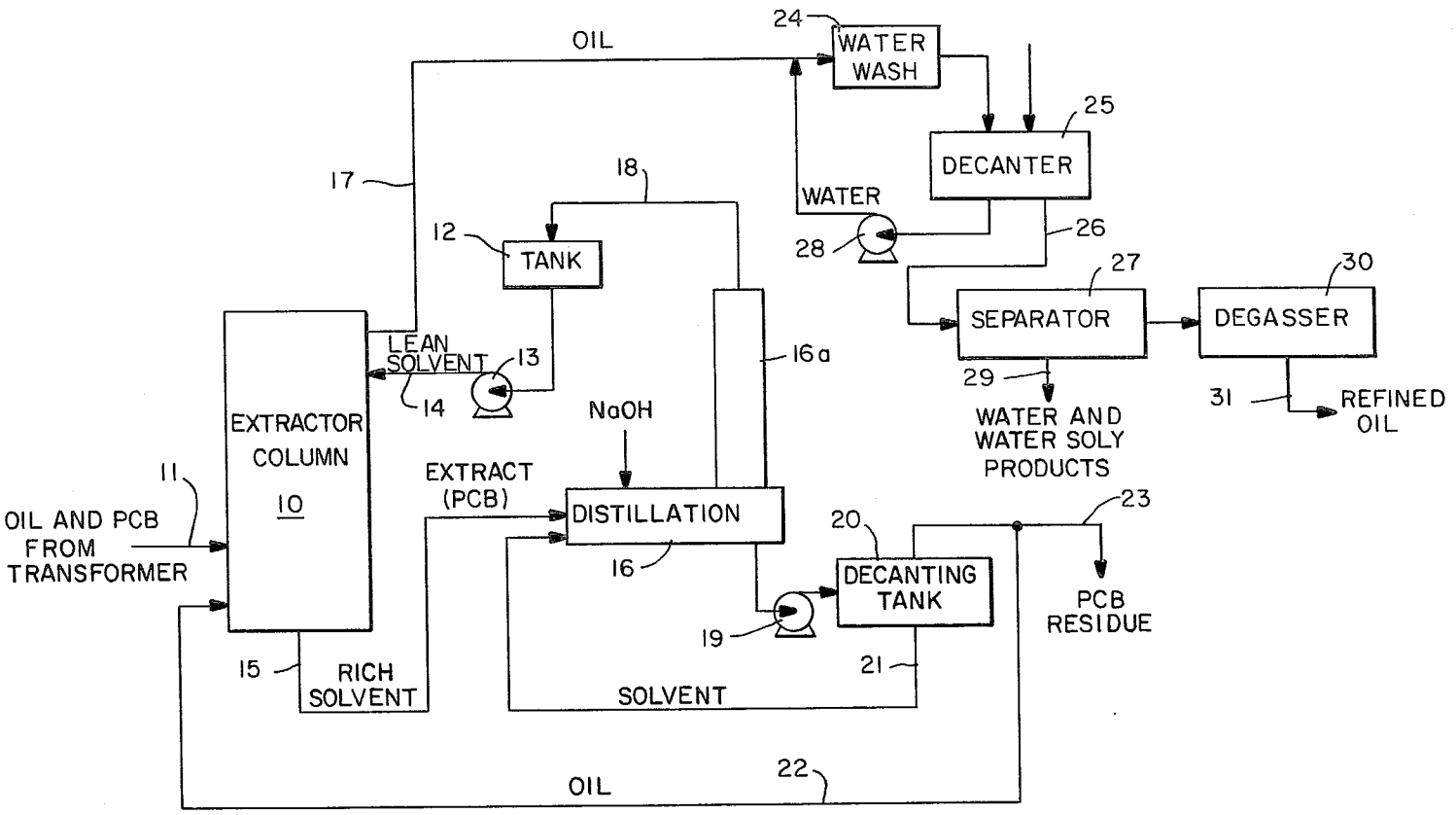
OIL AND PCB FROM TRANSFORMER
11
EXTRACTOR COLUMN 10
15
RICH SOLVENT
EXTRACT (PCB)
LEAN SOLVENT
14
13
TANK
12
17
OIL
18
NaOH
DISTILLATION
16
16a
19
SOLVENT
OIL
22
DECANTING TANK
20
21
PCB RESIDUE
23
WATER
28
WATER WASH
24
DECANTER
25
26
SEPARATOR
27
WATER AND WATER SOLY PRODUCTS
29
DEGASSER
30
31
REFINED OIL

DESTRUCTION OF POLYCHLORINATED BIPHENYLS DURING SOLVENT DISTILLATION

The present invention is directed to a method for removing polychlorinated biphenyls (PCB) from oil contaminated therewith.

The class of compounds known as polychlorinated biphenyls (PCB) has properties which make these compounds ideal for various applications in heat transfer systems and electrical equipment. However, it is suspected that PCB may cause health problems to the public at large, therefore the manufacture and use thereof in commercial applications has been discontinued. Government regulations have been promulgated to control those materials currently in use and to control the level of exposure thereof to the general public.

One source of PCB currently found in use is in contaminated transformer oils. Although various chemical and physical methods have been developed to treat PCB-contaminated oils, it has been found that it is difficult to develop a process which will be effective in meeting the increasingly stringent government regulations pertaining to PCB concentration, yet will be economically feasible for industrial use. A method utilized involves a double extraction of the PCB-contaminated oil whereby the transformer oil is extracted with a first solvent. The first solvent extract is then isolated and extracted with a second solvent whereby the phase containing the first solvent is recycled and the extract containing the second solvent is mixed with a base such as sodium hydroxide in polyethylene glycol, to convert the PCB into water soluble derivatives and organic residue. The product is then washed with water whereby the aqueous phase and then the second solvent phase are separated and the second solvent is recycled for reuse, while the water phase containing the PCB decomposition products is collected for disposal. The disadvantage of the aforementioned method is that there is an added expense and complexity in the plant for the equipment required for two extractions involving the first and second solvents, in addition to the reactor for the sodium hydroxide/polyethylene glycol reaction and an aqueous extraction following the reaction.

The present invention provides a method for removing PCB from PCB-contaminated oil without the above degree of complexity and expense.

It is therefore an object of the present invention to provide an improved method for decontaminating PCB-contaminated oil. It is a further object of the present invention to provide a method for removing PCB from PCB-contaminated oil utilizing a single solvent extraction step and a distillation step.

The present invention provides a method for removing polychlorinated biphenyls present in PCB-contaminated oil comprising the steps of (a) extracting PCB from the PCB-contaminated oil with an organic solvent; (b) separating the PCB-containing organic solvent extract from the oil phase of step (a); and (c) distilling the organic solvent from the extract in the presence of a base to yield a non-distillable residue containing PCB decomposition products.

The accompanying FIGURE illustrates the preferred embodiment of the means for accomplishing the method according to the present invention.

It is known that the addition of strong bases to PCB-contaminated oil will destroy the PCB, however strong bases may also damage the oil and render the oil unsuitable for reuse. Therefore, the step of extracting the PCB from the oil using a suitable solvent is a feasible approach to solving the problem, but in order to be economically attractive, the solvent used in the extraction steps should be recycled. It has therefore been found that the PCB may be extracted from PCB-contaminated oil using an organic solvent having a relatively low boiling point in comparison with the boiling point range of PCB. It has further been found that if such a solvent is relatively non-reactive with strong bases, such as sodium or potassium hydroxide, then such solvents may be distilled from the PCB in the presence of a strong base. The distillation accomplishes recovery of a substantial fraction of the solvent in a substantially pure form for recycling, while simultaneously destroying the PCB by conversion to salts and residues and separating the residue from the solvent extract.

The solvents utilized according to the present invention are such that PCB is substantially soluble therein and such that their boiling points are substantially below the boiling points of PCB. Such solvents may be selected from polyethylene glycol ethers, cyclic ethers, linear or branched alkanes containing up to about 12 carbon atoms, cycloalkanes, and low boiling polar organic solvents, such as, dimethylsulfoxide. More particularly, the solvent may be selected from diethylene glycol ethers, cyclic ethers containing less than 10 carbon atoms, alkanes containing less than 10 carbon atoms, cycloalkanes containing less than 10 carbon atoms and dimethylsulfoxide. The preferred solvents are the diethylene glycol ethers, tetrahydrofuran, heptane, hexane, cyclopentane, cyclohexane, cycloheptane, cyclooctane and dimethylsulfoxide. The solvents must be substantially non-reactive with strong bases such as sodium or potassium hydroxide. The most preferred class of solvents according to the present invention is the polyethylene glycol ethers. Particularly preferred are the alkyl and dialkyl ethers of diethylene glycol such as the diethyl ether, ethyl ether and methyl ether. The most preferred solvent is diethylene glycol methyl ether, commonly known as methylcarbitol, having a boiling point of about 193° C.

The boiling points of the solvent are substantially below the boiling range of PCB. Since PCB normally have boiling points in the range of about 260° C. and above, it is preferred that the solvents utilized according to the present invention have boiling points substantially below 260°, preferably below about 200° C. In addition to diethylene glycol methylether, exemplary solvents utilized according to the present invention may be diethylene glycol diethylether (boiling point 189° C.). diethylene glycol monomethyl ether (boiling point 195° C.), dimethylsulfoxide (boiling point 189° C.), cyclohexane (boiling point about 81° C.), hexane (boiling point 69° C.), or tetrahydrofuran (boiling point 67° C.).

According to the present invention the PCB-contaminated oil is first extracted with a solvent, then the solvent extract containing the PCB is separated and placed into a container. The container will contain a strong base, such as potassium or sodium hydroxide, preferably sodium hydroxide. Other bases which may be utilized include the hydroxides and oxides of alkali metals and alkaline earth metals. The solvent is then distilled while simultaneously the sodium hydroxide undergoes reaction with the PCB, thereby destroying the PCB. The distilled solvent is collected from the top of the distillation column and recycled. The residue bottoms of the distillation column containing PCB decomposition products, sodium hydroxide and other insoluble decomposition products may then be collected. Any solvent or transformer oil remaining in the residue may then be appropriately decanted from the solid residue and recycled. The solid PCB decomposition product-containing residue may then be discarded according to regulatory procedures.

Referring the the FIGURE, there is shown an extractor column 10 which is supplied by PCB-contaminated oil through line 11. Solvent is stored in tank 12 and is fed into extraction column 10 by pump 13 via line 14. Solvent which is enriched in PCB is withdrawn from column 10 through line 15 and fed into distillation pot 16. Oil which is substantially free of PCB contamination is conducted from the extracted column via line 17, washed and degassed as described hereinbelow. If the PCB-contaminated feed oil is transformer oil, such oil may contain approximately 200 to 300 ppm PCB. Subsequent to extraction with solvent, preferably methylcarbitol, the oil exiting the extractor 10 via line 17 may contain approximately 2% of the original PCB present. Therefore, if the feed oil is PCB-contaminated transformer oil, subsequent to extraction with methylcarbitol the oil may contain 4 to 6 ppm PCB or less, which is within the acceptable limit according to current government regulations.

Distillation pot 16 may contain reagent for the destruction of the PCB. Basic reagents may be potassium or sodium hydroxide, either in solid form or in concentrated aqueous solution. An amount of base should be present sufficient to destroy the quantity of PCB present in the contaminated oil. Typically, there will be substantial excess of base present in distillation pot 16. The solvent is distilled from distillation pot 16 through distillation column **16*a* and conducted from the top of column 16*a* through line 18 into solvent storage tank 12 for recycling into extractor column 10**.

The residue remaining in the distillation pot 16 will contain PCB decomposition products, as well as some residual solvent and oil. This residue is pumped through pump 19 into decanting tank 20. Residual solvent is decanted from the contents of tank 20 and led via line 21 back into the distillation pot 16. The residuals from tank 20 may contain oil which is separable by decantation from the residue. This separable oil may be recycled into the extractor column 10 via line 22. The remaining residue may be drawn off through line 23 in an appropriate solvent, if necessary, and destroyed.

Preferably the solvent utilized in the extractor column 10 is a water-miscible organic solvent, such as, a polyethylene glycol ether. The oil exiting line 17 which is substantially free of PCB may contain some solvent, therefore this oil is mixed with water in water wash static mixer 24 which strips the water-miscible solvent from the oil. The aqueous and oil phases are allowed to separate in decanter 25 whereby the oil-containing phase is withdrawn through line 26 and into water separator 27. The water phase from decanter 25 is recycled through pump 28 to be used as a feed for the water washed static mixer 24. Residual water and water-soluble products are withdrawn from separator 27 via line 29. The refined oil is passed through degasser 30 and collected through line 31.

Many modifications and variations of the present invention are readily obvious to those of ordinary skill in the art in light of the above specification and embodiments and it is understood that such modifications and variations are within the scope of the present invention.

What is claimed is:

1. A method for removing polychlorinated biphenyl compounds from oil contaminated therewith, comprising the steps of:

(a) extracting said polychlorinated biphenyl compounds from said oil with an organic solvent selected from the group consisting of polyethylene glycol ethers, cyclic ethers, linear or branched alkanes of less than about 12 carbon atoms, cycloalkanes, and polar organic solvents having a boiling point less than about 200° C., (b) separating the solvent extract containing said polychlorinated biphenyl compounds from the oil phase in step (a), and (c) distilling said solvent from said extract in the presence of an effective amount of a base selected from the hydroxides and oxides of alkali and alkaline earth metals to destroy said polychlorinated biphenyl compounds forming a solvent distillate and a distillation residue containing salts and polychlorinated biphenyl decomposition products and collecting the solvent distillate for use in step (a).

2. A method according to claim 1 wherein said solvent is selected from diethylene glycol ethers, cyclic ethers containing less than 10 carbon atoms, alkanes containing less than 10 carbon atoms, cycloalkanes containing less than 10 carbon atoms, and dimethylsulfoxide.

3. A method according to claim 2 wherein said solvent is selected from diethylene glycol ethers, tetrahydrofuran, heptane, hexane, cyclopentane, cyclohexane, cycloheptane, cyclooctane and dimethylsulfoxide.

4. A method according to claim 3 wherein said solvent is selected from a diethylene glycol alkyl ether and a diethylene glycol dialkyl ether.

5. A method according to claim 4 wherein said solvent is diethylene glycol methyl ether.

6. A method according to claim 1 wherein the said base is selected from sodium hydroxide or potassium hydroxide.

7. A method according to claim 6 wherein said base is sodium hydroxide.

8. A method according to claim 7 whereby said extraction step (a) removes 98% or more of said polychlorinated biphenyl compounds from said oil.

* * * * *